United States Patent [19]

Mawhinney et al.

[11] 4,232,427

[45] Nov. 11, 1980

[54] UNITARY BUTTON FASTENER

[76] Inventors: Gladys F. Mawhinney, 6202 S. Euclid, Tucson, Ariz. 85734; George H. McFerron, 2700 N. Sunrock La., Tucson, Ariz. 85705

[21] Appl. No.: 29,639

[22] Filed: Apr. 13, 1979

[51] Int. Cl.[3] ..... A44B 1/18; A44B 1/26

[52] U.S. Cl. ..... 24/90 R; 24/103; 24/208 A

[58] Field of Search ..... 24/90 R, 90 TA, 103, 24/208 A

[56] References Cited

U.S. PATENT DOCUMENTS

| | | | |
|---|---|---|---|
| 2,104,885 | 1/1938 | Robbins | 24/90 R |
| 3,349,447 | 10/1967 | Raleigh, Jr. | 24/90 R |

OTHER PUBLICATIONS

Offenlegungsschrift, No. 2 136 370 to Berger-2/1973.

*Primary Examiner*—Ramon S. Britts
*Assistant Examiner*—Alexander Grosz
*Attorney, Agent, or Firm*—Cahill, Sutton & Thomas

[57] ABSTRACT

A unitary button fastening device includes a base plate, a flexible pointed shaft attached to one side of the base plate and having a plurality of directional flanges or barbs spaced thereon, and a retaining aperture in the base plate. The flexible shaft is passed in a U-shaped path through a fabric, through eyelets of a button, through the fabric again, and finally through the retaining aperture to tighten the button against the fabric. The last directional flange or barb is returned by the retaining aperture. Excess shaft material extending beyond an appropriate side of the base plate is clipped off.

6 Claims, 8 Drawing Figures

UNITARY BUTTON FASTENER

BACKGROUND OF THE INVENTION

1. Field of the Invention

The invention relates to unitary button attaching apparatus and methods for attaching buttons to fabric.

2. Description of the Prior Art

A number of known devices have been developed to fasten buttons to a fabric or the like without use of thread and needle. However, many of the prior buttoning button fastening devices include several parts which are inconvenient to manipulate and are easily lost. Various unitary button fastening systems having pointed shafts or filaments extending from retaining members are known. In such unitary button fastening systems, the pointed members typically are passed through fabric to which the button is to be attached, through eyelets of a button, tracing U-shaped paths back through the fabric and through one or more apertures in the retaining elements from which the pointed filaments or members initially extend.

U.S. Pat. No. 3,785,009 discloses a button fastening system having a disc-shaped plate from which a pointed filament extends. The pointed filament is passed through the underside of the fabric and through one or more eyelets of a button disposed on the opposite side of the fabric. The pointed filament then is passed through a pair of elongated filament guide passages which are provided on the plate in respective intersecting planes. The pointed filament is pushed successively through the two guide passages to form a loop through which the free end portion of the filament is then pulled so that it is located in a groove of the plate extending under the loop. The filament is then tightened and the excess removed. However, the device described in U.S. Pat. No. 3,785,009 is difficult to use because of the need for considerable manipulation of the filament in order to tighten the filament and secure it to the base plate.

Another unitary button fastening element disclosed in U.S. Pat. No. 3,894,317 has similar shortcomings in that it is unwieldy to use, as it requires a number of manipulations to secure the elongated filament after it has been passed through eyelets of the button, back through fabric to a unitary base from which the filament originally extends.

The button fastener disclosed in U.S. Pat. No. 3,754,304 suffers from similar shortcomings as the previously mentioned devices; considerable dexterity is needed to grip the flexible filament of U.S. Pat. No. 3,754,304, pass it through a horizontal sleeve, grasp the end of the filament extending beyond the sleeve and tightly drawing it through the horizontal sleeve. Further, the button fastener of U.S. Pat. No. 3,754,304 is relatively expensive due to the cost of producing a roughened inner sleeve surface and a corresponding roughened filament surface to ensure adequate friction between the filament and the inner sleeve surface. This button fastener can not be manufactured with a roughened inner sleeve surface solely by low cost injection molding processes.

Accordingly, it is an object of the invention to provide a unitary button fastening device which requires less manipulation than prior button fasteners to reliably secure a button to fabric.

Another object of the invention is to provide a unitary button fastening device which is more reliable and yet less expensive to manufacture than prior button fasteners.

A simple unitary button fastening system is disclosed in U.S. Pat. No. 3,925,855 wherein a prong extending directly from the back of a button includes barbs which are pushed through fabric and retain the prong from being withdrawn through the fabric in the reverse direction. Excess prong material then is cut off. However, this device has the severe shortcoming that it is likely to damage the fabric, both during installation and as a result of damage done to the underside of the fabric by the prongs when a pulling force is exerted on the button.

Accordingly, it is still another object of the invention to provide a unitary button fastening system which does not damage fabric appreciably during installation of the button or afterward due to normal forces applied to the button.

U.S. Pat. No. 4,063,312 discloses a variety of other unitary button fastening systems, all of which are unduly costly to manufacure because of their complex structures and require an undue amount of manipulation and alignment of parts to fasten a button to fabric.

Accordingly, it is a primary object of the invention to provide a low cost, reliable unitary button fastening system which overcomes the shortcomings of the above described prior button fastening devices.

SUMMARY OF THE INVENTION

Briefly described, and in accordance with one embodiment thereof, the invention provides a button attaching device including a disc-shaped base plate and a flexible shaft extending perpendicularly from a first point of a first surface of the base plate. A plurality of flexible flanges over barbs are spaced along the length of the flexible shaft. Beyond the last flexible flange or barb the shaft tapers to a pointed end. The flexible shaft is sufficiently rigid that the tapered point can be forced through fabric toward which a button is to be attached. A retaining aperture spaced from the first point of the first surface of the base plate is surrounded by one or more semi-rigid flanges. In use, the pointed end is forced through fabric to which a button is to be attached. The pointed end is looped through one or more eyelets in the button, forming a U-shpaed path in the process. The pointed end is drawn through the retaining aperture, and one or more of the flexible flanges or barbs are also drawn through the aperture until the flexible shaft is drawn into a tight U-shaped path to secure the button against the fabric. The excess portion of the flexible shaft is removed. One of the flexible flanges or barbs retains the end of the flexible shaft from being withdrawn through the retaining aperture.

In one embodiment of the invention, a spacer having holes which are aligned with eyelets of the button is placed between the button and the fabric. The flexible shaft is passed through the aligned holes and eyelets of the spacer and the button. This embodiment of the invention is particularly suitable when fabric having a buttonhole to which the button can be "buttoned" is exceptionally thick. In another embodiment of the invention, a vertical loop forming an eyelet extends from the underside of the button to be fastened. The flexible shaft extends through the eyelet, back through the fabric, and through the retaining aperture. The described embodiment of the invention is formed as a unitary device from a suitable plastic, such as nylon. For buttons having four holes or eyelets, a pair of spaced flexible shafts extending vertically from the base plate are utilized. A pair of corresponding spaced flange or barb retaining holes are provided in the base plate.

DESCRIPTION OF THE INVENTION

Figure 1:
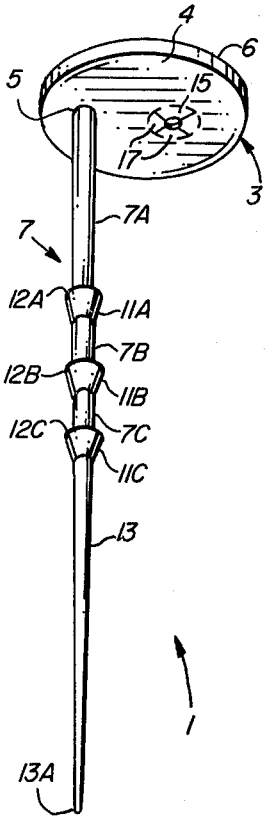
FIG. 1 is a perspective view of a unitary button fastener of the invention.

Referring now to FIG. 1, unitary button fastener 1 includes a disc-shaped base plate 3 having a first surface 4 and a second opposed surface 6. A flexible shaft or filament 7 extends vertically from point 5 of first surface 4. A plurality of tapered flanges 11A, 11B and 11C are disposed along flexible shaft 7. A base portion 7A of flexible shaft 7 is disposed between the first tapered flange 11A. Shaft sections 7B and 7C are disposed between tapered flange sections 11A, 11B and 11C, respectively. In practice, more than three tapered flanges spaced more closely than illustrated in FIG. 1 may be desirable. A pointed end section 13 of flexible shaft 7 extends on the end of the last tapered flange 11C.

Flexible shaft 7 and base plate 3 are preferably integrally formed by low cost injection molding processes from suitable plastic such as nylon. The thickness of flexible shaft 7 is selected so that it can be easily bent in a U-shaped path, as subsequently explained.

The tapering angle of flanges 11A–11C is in the direction shown in FIG. 1 in order to permit easy passage of tapered flanges 11A–11C through retaining aperture 15 in base plate 3. Pointed end section 13 is sufficiently thick and rigid that it can be manipulated easily and end point 13A can be easily inserted through retaining aperture 15.

Retaining aperture 15 has a diameter substantially less than the diameter of the bases 12A, 12B and 12C of flexible flanges 11A, 11B and 11C, respectively. The inside diameter of retaining aperture 15 may be approximately equal to the diameter of the portions of flexible shaft 7 at the small diameter ends of the tapered flanges.

The purpose of the retaining aperture 15 is to permit one or more of tapered flanges 11A–11C to easily pass through retaining aperture 15 in the direction from first surface 4 to second surface 6 and to prevent withdrawal of any of the tapered flanges from retaining aperture 15 after it has been drawn through retaining aperture 15.

It is not essential that tapered flanges 11A–11C be flexible. If they are rigid, however, then it is necessary that the periphery of retaining aperture 15 be somewhat flexible. This can be accomplished by provision of one or more semi-rigid retaining flanges 17 around the periphery of retaining aperture 15, as shown in FIG. 1.

Due to the simplicity of the unitary button fastener 1, it can be inexpensively manufactured by means of well known injection molding techniques.

Figure 2:
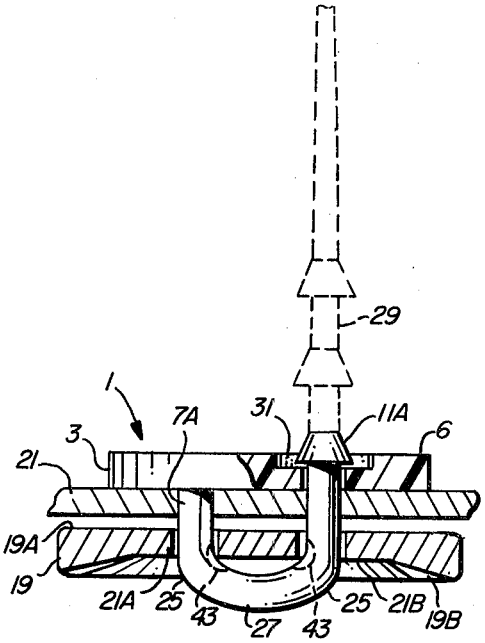
FIG. 2 discloses a section view illustrating a button fastened to a piece of fabric by means of the unitary button fastener of FIG. 1.

Referring now to FIG. 2, a button 19 having holes or eyelets 21A and 21B therein is attached to a piece of fabric 21 by passing pointed tip 13A of end section 13 through fabric 21 from the upper side thereof. Pointed tip 13A is then passed through eyelet 21A; of course, tapered flanges 11A–11C are also drawn through both the fabric 21 and first eyelet 21A. The flexible shaft base section 7A is then bent; shaft sections 7B and 7C and also end section 13 are bent as necessary to guide pointed tip 13A through eyelet 21B from the outer side 19B of button 19.

Pointed tip 13A then is forced through another point of fabric 21 aligned with second eyelet 21B. Pointed tip 13A then is guided through retaining aperture 15, and enough of flexible shaft 7 is drawn through second eyelet 21B, the punctured hole in fabric 21 and retaining aperture 15 to suitably tighten button 19 against fabric 21. Excess portions of flexible shaft 7, designated by dotted line 29 in FIG. 2, then are clipped off.

A recess 31 is provided in second surface 6 of base plate 3 to minimize the extent of tapered flange 11A beyond second surface 6.

In order to effect easier, more stress-free bending of flexible shaft base portion 7A, a plurality of thinner regions, designated by dotted lines 43 in FIG. 2, may be provided along points of flexible shaft base section 7A at which sharp bends may occur for fastening a particular type of button to a particular type of fabric.

Figure 3:
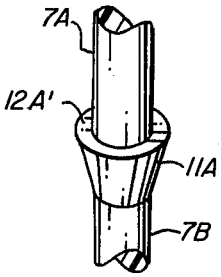
FIG. 3 is an enlarged view illustrating a directional flexible flange on the flexible shaft of the unitary button fastener of FIG. 1.

As mentioned above, tapered flanges 11A–11C may have flexible base portions, such as 12A–12C; in fact, flexible base portions will be required if the periphery of retaining aperture 15 is rigid. FIG. 3 illustrates a concave or inwardly tapered region 12A' in the base portion of tapered flange 11A. Inwardly tapered region 12A' permits the outer portions of the base 12A of tapered flange 11A to be flexible and bend inwardly to permit passage of tapered flange 11A through a rigid periphery retaining hole.

Figure 4:
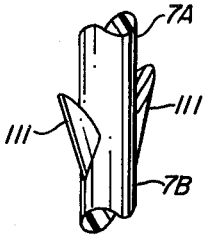
FIG. 4 is an enlarged view of directional barbs attached to the flexible shaft of the embodiment of FIG. 1 in place of the flexible flanges.

Alternatively, a plurality of tapered barbs 111 can be integrally formed with flexible shaft 7 in place of tapered flanges such as 11A–11C, as shown in FIG. 4. In some cases, barbs such as 111 may be more easily inserted through both fabric and retaining hole 14, and still adequately prevent withdrawal of flexible shaft 7 from retaining hole 15.

Figure 5:
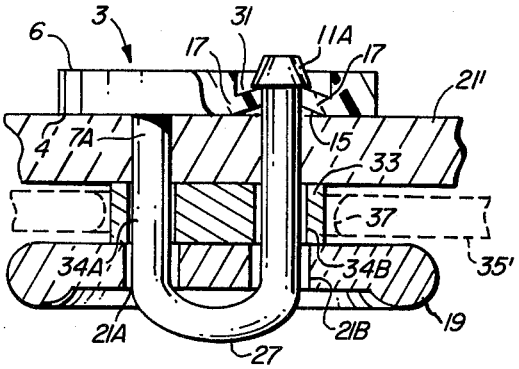
FIG. 5 discloses an alternate embodiment of the invention including a spacer disposed between the button and the fabric by means of the unitary button fastener of FIG. 1.

In another embodiment of the invention, flexible retaining aperture peripheral flanges 17 may be directionally oriented toward the second surface 6 of base plate 3, as illustrated in the sectional view of FIG. 5. This results in increasingly effective retention of either tapered flanges 11A or tapered barbs 111 within retaining hole 15, and also increases the ease with which the tapered flanges or barbs are drawn through retaining aperture 15 from first side 4 to second side 6 of base plate 3.

If button 19 is to be buttoned to another piece of exceptionally thick fabric 35' having a buttonhole 37 sewn therein, a plastic spacer 33 having holes 34A and 34B therein can be aligned with eyelets 21A and 21B of button 19. Pointed tip 13A of unitary button fastener 1 then can penetrate fabric 21' and be guided through hole 35A of spacer 33 and eyelet 21A of button 19. Pointed tip 13A then can be drawn through a U-shaped path, guided through eyelet 21B of button 19 and hole 34B of spacer 33 to again puncture fabric 21' and be passed through retaining aperture 15. After flexible shaft 7 has been drawn through retaining hole 15 to tighten button 19 against spacer 33 and fabric 21 and the excess portion of flexible shaft 7 has been cut off, the structure appears as shown in the sectional view of FIG. 5.

Figure 6:
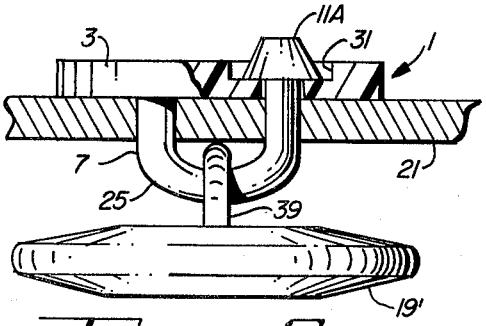
FIG. 6 discloses use of the unitary button fastener of FIG. 1 to fasten a button having a vertical eyelet.

FIG. 6 discloses use of unitary button fastening device 1 to attach button 19' having vertical eyelet 39 to fabric 21.

Figure 7:
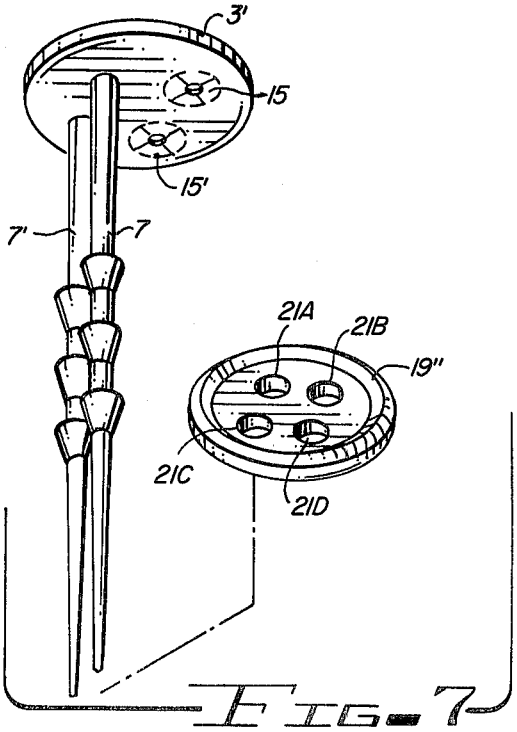
FIG. 7 discloses an alternate embodiment of the invention having two flexible shafts extending from a single base plate.

FIG. 7 discloses another embodiment of the unitary button fastener of the invention for use with buttons having four eyelets, whereby two flexible shafts 7 and 7' having the characteristics described above are integrally attached to a single base plate 3' having two corresponding retaining holes 15 and 15' therein.

Figure 8:
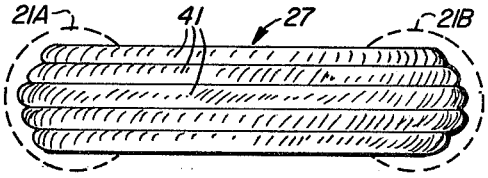
FIG. 8 discloses a decorative surface design for the flexible shaft simulating the appearance of real thread.

Referring now to FIG. 8, an outer view of an exposed portion 27 of flexible shaft 7 extending through holes 21A and 21B of button 19 includes a plurality of longitudinal grooves 41 which simulate the appearance of real thread. The color of the plastic material used can be provided in a wide variety of different shades to match various fabric colors.

While the invention has been described with reference to several embodiments thereof, those skilled in the art will be able to make numerous variations in the disclosed combination of elements without departing from the true spirit and scope of the present invention.

We claim:

1. A button attaching system for attaching a button having a hole or eyelet therein to a fabric, said button attaching system comprising in combination:

a. a base element having opposed first and second surfaces, said base element having a retaining aperture extending through said base element from said first surface to said second surface, said base element having a thickness which is substantially less than the lateral dimensions of said first and second surfaces;

b. a shaft having a first end attached to said first surface extending approximately perpendicularly from an attachment point of said first surface, said shaft including a sharp second end for penetrating the fabric, said attachment point being spaced from said retaining aperture, said flexible shaft being sufficiently flexible to permit said shaft to be bent to pass said second end through said hole, the portion of said shaft remaining on the first surface side of said base element forming a U-shaped path; and c. retaining means attached to said shaft between said first and second ends for allowing said shaft to be easily passed through said retaining hole in the direction from said first side to said second side and preventing said shaft from being moved through said retaining hole in the direction from said second surface to said first surface, the portion of said second end of said shaft being removable after said passing of said shaft through said retaining hole;

said retaining means including a tapered element extending outwardly from said shaft, said tapered element having a first surface slightly inclined outwardly from the surface of said shaft and a second surface steeply inclined outwardly from the surface of said shaft, a plurality of flange means disposed around the periphery of said retaining aperture for flexing toward said second surface of said base element in response to pressing of said first slightly inclined surface against said flange means as said tapered element is forced through said retaining aperture by a first force applied in a first direction to said shaft, said flange means also resisting flexing toward said first surface of said base element in response to pressing of said second steeply inclined surface against said flange means as a second force is applied to said shaft in a direction opposite to said first direction, said second force being substantially greater than said first force, said base element and said shaft being composed of plastic material, said base element being sufficiently thick that it is substantially unflexible, whereby said second end of said shaft can be passed through the fabric, one or more holes or eyelets of the button, back through the fabric, and through said retaining aperture fasten the button to the fabric.

2. The button attaching system of claim 1 wherein said base element is disc-shaped and is integral with said shaft.

3. The button attaching system of claim 2 made of nylon.

4. The button attaching system of claim 1 wherein said tapered element includes a flexible barb which bends toward said shaft to allow passing of said shaft through said retaining hole in the direction from said first surface to said second surface and flexes outwardly from said shaft beyond the edge of said retaining hole to effect said preventing of movement in the direction from said second surface to said first surface.

5. The button attaching system of claim 1 wherein said tapered element includes a flexible flange which flexes toward said shaft to allow passing of said shaft through said retaining hole in the direction from said first surface to said second surface and flexes outwardly from said shaft beyond the edge of said retaining hole to effect said preventing of movement in the direction from said second surface to said first surface.

6. The button attaching system of claim 1 wherein said flexible flange means are integral with said base element.

* * * * *